US010897995B2

(12) United States Patent
Crum et al.

(10) Patent No.: US 10,897,995 B2
(45) Date of Patent: Jan. 26, 2021

(54) PIVOT-OVER-ARM RECLINING MECHANISM FOR A SEATING UNIT AND MODULAR SEATING UNIT CONNECTION SYSTEM

(71) Applicant: L&P Property Management Company, South Gate, CA (US)

(72) Inventors: Michael Andrew Crum, Mantachie, MS (US); Cheston Brett Crawford, Randolph, MS (US); Gregory Mark Lawson, Tupelo, MS (US)

(73) Assignee: L&P PROPERTY MANAGEMENT COMPANY, South Gate, CA (US)

( * ) Notice: Subject to any disclaimer, the term of this patent is extended or adjusted under 35 U.S.C. 154(b) by 0 days.

(21) Appl. No.: 16/550,650

(22) Filed: Aug. 26, 2019

(65) Prior Publication Data

US 2020/0113333 A1 Apr. 16, 2020

Related U.S. Application Data

(60) Provisional application No. 62/745,455, filed on Oct. 14, 2018.

(51) Int. Cl.
*A47C 1/034* (2006.01)
*A47C 1/035* (2006.01)
*A47C 1/0355* (2013.01)

(52) U.S. Cl.
CPC ..... *A47C 1/0355* (2013.01)

(58) Field of Classification Search
CPC ..... A47C 1/0355
USPC ..... 297/83–85 L
See application file for complete search history.

(56) References Cited

U.S. PATENT DOCUMENTS 3,622,198 A * 11/1971 Re ..... A47C 1/0355 297/84 X
4,071,275 A * 1/1978 Rogers, Jr. ..... A47C 1/0355 297/85 L X
4,108,491 A * 8/1978 Rogers, Jr. ..... A47C 1/0355 297/85 L X
4,519,647 A * 5/1985 Rogers, Jr. ..... A47C 1/0355 297/85 L X
4,531,778 A * 7/1985 Rogers, Jr. ..... A47C 1/0355 297/85 L X
4,544,201 A * 10/1985 Rogers, Jr. ..... A47C 1/0355 297/84 X
4,815,788 A * 3/1989 May ..... A47C 1/0355 297/85 L X
4,878,710 A * 11/1989 Tacker ..... A47C 1/0355 297/85 R X
4,904,019 A * 2/1990 May ..... A47C 1/0355 297/85 R X (Continued)

OTHER PUBLICATIONS

International Search Report and Written Opinion for PCT Application No. PCT/US2019/051973, dated Feb. 10, 2020, 18 pages.

*Primary Examiner* — Rodney B White
(74) *Attorney, Agent, or Firm* — Shook, Hardy & Bacon L.L.P.

(57) ABSTRACT

A simplified, compact, recliner mechanism which can be adapted to essentially any type of seating unit is disclosed. The seat-drop and the over-center linkages, as well as the seat-drop movement, may be eliminated utilizing a simplified recliner linkage and a linear actuator to control movement of the recliner mechanism.

19 Claims, 15 Drawing Sheets

(56) References Cited

U.S. PATENT DOCUMENTS 5,011,220 A 4/1991 LaPointe
5,072,988 A * 12/1991 Plunk ..... A47C 1/0352 297/85 L X
5,352,017 A 10/1994 Berning
5,360,255 A * 11/1994 Cook ..... A47C 1/0355 297/85 R X
5,520,437 A 5/1996 LaPointe et al.
5,544,938 A 8/1996 Saul et al.
5,588,710 A * 12/1996 Wiecek ..... A47C 1/0355 297/85 L X
5,775,775 A * 7/1998 Hoffman ..... A47C 1/0355 297/85 R X
5,975,627 A 11/1999 LaPointe et al.
6,932,428 B2 8/2005 Murphy
7,261,367 B2 8/2007 Duncan et al.
7,445,279 B2 11/2008 Crum
7,673,933 B2 * 3/2010 Lawson ..... A47C 1/0345 297/85 M X
7,762,625 B2 * 7/2010 Hoffman ..... A47C 1/034 297/85 L
7,766,421 B2 * 8/2010 Lawson ..... A47C 1/0355 297/85 R
8,308,228 B2 * 11/2012 Lawson ..... A47C 1/035 297/85 R
8,696,054 B2 * 4/2014 Crum ..... A47C 1/0352 297/85 M
8,833,845 B2 * 9/2014 Hoffman ..... A47C 1/034 297/85 L
9,022,473 B2 * 5/2015 Crum ..... A47C 1/0355 297/85 L X
2009/0174251 A1 * 7/2009 Lawson ..... A47C 1/0352 297/85 R
2011/0175404 A1 * 7/2011 Lawson ..... A47C 1/0355 297/83
2011/0175426 A1 * 7/2011 Lawson ..... A47C 1/0355 297/85 M
2011/0181094 A1 * 7/2011 Lawson ..... A47C 1/035 297/85 R
2012/0049606 A1 * 3/2012 Lawson ..... A47C 1/0355 297/85 M
2012/0112519 A1 5/2012 Murphy et al.
2013/0175847 A1 * 7/2013 Lawson ..... A61G 5/14 297/85 M
2014/0327282 A1 11/2014 Crum
2015/0282619 A1 * 10/2015 Lawson ..... A47C 1/032 297/83

* cited by examiner

PIVOT-OVER-ARM RECLINING MECHANISM FOR A SEATING UNIT AND MODULAR SEATING UNIT CONNECTION SYSTEM

CROSS-REFERENCE TO RELATED APPLICATION

This application claims the benefit of U.S. Provisional Application No. 62/745,455, filed Oct. 14, 2018.

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the present invention relates to an improved reclining mechanism developed to accommodate a wide variety of styling for a seating unit which is otherwise limited by the configurations of recliner mechanisms in the field.

Reclining seating units exist that allow a user to forwardly extend a footrest and to recline the chair back relative to the seat. These existing seating units typically provide three basic positions: a normal non-reclined sitting position with the seat generally horizontal and the back substantially upright; a partially reclined position often referred to as a "TV" position wherein the seat and back are disposed in a slightly reclined position but with the back still sufficiently upright to permit comfortable television viewing from the seating unit; and a fully reclined position wherein the back is pivoted toward horizontal into an obtuse relationship with the seat for lounging or sleeping. Most reclining seating units include a footrest coordinated with the mechanical arrangement to be extended forwardly of the seat in the TV and fully reclined positions.

There are a number of reclining mechanisms in the industry that include the reclining capability and offer certain design capabilities to the furniture manufacturer. However, these reclining mechanisms are relatively complex and to some extent impose constraints on a furniture designer's concurrent use of multiple styling features into a reclining seating unit. One specific feature is a space saving utility that cures a disadvantage of many traditional seating units, wherein the hack in the fully reclined position will contact an adjacent wall unless the base is moved outwardly away from the wall. However, present seating units that incorporate the space saving utility have reclining mechanisms using linkages that reach from the arms to a base on the floor to accomplish this feature. As such, these existing seating units having the space saving utility have recliner mechanisms that are precluded from providing both a pivot-over-the-arm feature (which, for example, may allow a furniture designer to design the seating unit to have a winged back or "T" back) and arms that rest either directly on the floor or that are supported by high legs (e.g., the arms or high legs would drag along the floor as the recliner mechanism moves, and in some cases even interfere with such movement). Other existing seating units provide a combination of winged back seats that pivot-over-the arm or high legs but their linkage structure precludes providing a T-cushion seat design. In these seating units the seat and/or the structure supporting the seat move rearward relative to the arm or high legs as the seating unit moves between the closed, TV, and fully reclined positions. Thus, the arms and/or high legs of these seating units would interfere with the movement of the T-cushion seat. Still other existing seating unit configurations allow both a T-cushion seat and winged hacks that pivot-over-the-arm. However, these seating units require bulky complex reclining mechanisms that restrict the incorporation of a high leg feature that requires a compact mechanism residing between the leg tops and the seat. As such, furniture designers are forced to choose between styling options. Moreover, designers or manufacturers are forced to purchase and stock many different recliner mechanisms if each option is to be produced within the seating unit line.

A prior attempt to address this problem utilized a compact, manual reclining mechanism. That reclining mechanism allowed a seating unit to include a T-cushion seat, a winged back that pivots-over-the-arm, a space-saving utility, and an arm to floor feature or high leg configuration. That reclining mechanism allowed the seating unit to have a T-cushion by keeping the seat in a same position longitudinally (i.e., in a front-to-back direction of the seating unit) when the seating unit moved from the closed position to the TV position and by moving the seat forwardly in the front-to-back direction when the seating unit moved from the TV position to the fully reclined position. The forward movement in the front-to-back direction when the seating unit moved from the TV position to the fully reclined position provided the space-saving utility. That reclining mechanism pivoted-over-the-arm, and thus allowed the seating unit to have a winged back, by pivotally coupling a back support link (to which the winged back attached) to an arm bracket mounted on an arm of the seating unit, so the pivot point about which the back rotated was fixed relative to the arm. Because the reclining mechanism moved relative to the arm, generally, the seating unit was able to include an arm that extended to the floor or a high leg (these configurations are known in the furniture manufacturing industry as "wood-to-floor" or "arm-to-floor" and are used interchangeably). Because this reclining mechanism was manually operated, however, it required a number of additional links. For example, an over-center linkage was included to lock the footrest in the closed position so that it would not partially open due to slack in the reclining mechanism. As another example, a seat-drop linkage was also included to permit the seat to drop when the seating unit moved from the closed position to the TV position to help extend the footrest. It would be advantageous to provide a reclining mechanism that did not require either of these linkages. Further, some occupants find the seat-drop movement uncomfortable. It would be advantageous to provide a reclining mechanism that permitted each of the styling options discussed above but without the need for the seat-drop movement.

BRIEF SUMMARY OF THE INVENTION

Accordingly, one aspect of the present invention seeks to provide a simplified, compact, recliner mechanism which can be adapted to essentially any type of seating unit. At a high level, the seat-drop and the over-center linkages, as well as the seat-drop movement, may be rendered unnecessary and therefore eliminated by utilizing a linear actuator (e.g., an electrically-driven extension rod) to control the position of the recliner mechanism and thus the seating unit. Use of the linear actuator to control movement of the recliner mechanism rather than a manually-operated control lever provides many advantages, such as, for example, enhanced comfort for a seating unit occupant, reduced material and labor costs, and more precise control of the seating unit between the closed, TV, and fully reclined positions.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
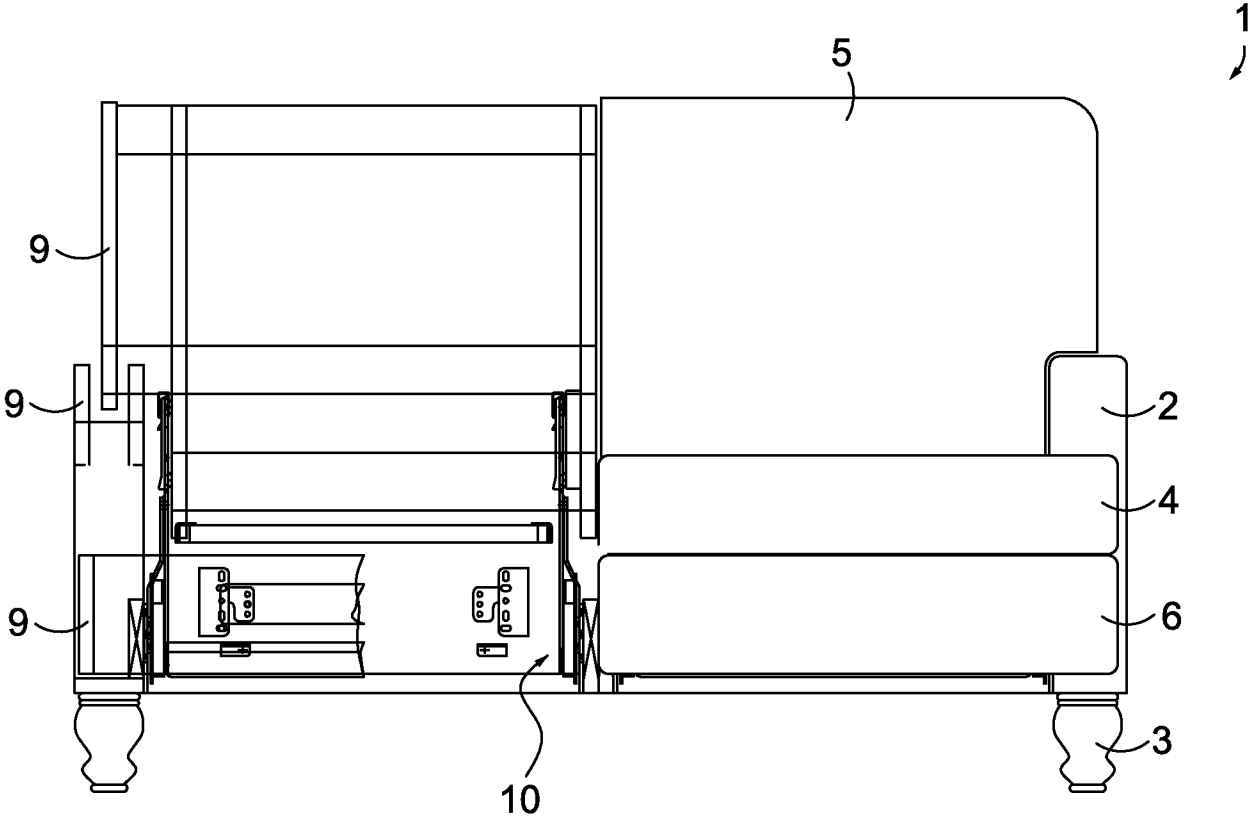
FIG. 1 is a front view of a reclining seating unit in a closed position, with the upholstery removed from one side and a portion of a recliner mechanism illustrated, in accordance with aspects hereof.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other present or future technologies. Further, it should be appreciated that the figures do not necessarily represent an all-inclusive representation of the embodiments herein and may have various components hidden to aid in the written description thereof.

Aspects hereof may be described using directional terminology. For example, the Cartesian coordinate system may be used to describe positions and movement or rotation of the features described herein. Accordingly, some aspects may be described with reference to three mutually perpendicular axes. The axes may be referred to herein as lateral, longitudinal, and vertical, and may be indicated by reference characters X, Y, and Z, respectively, in the accompanying figures. For example, the terms "vertical" and "vertically" as used herein refer to a direction perpendicular to each of the lateral and longitudinal axes. As a further example, the longitudinal axis may extend in a front-to-back direction of a seating unit and the lateral axis may extend in a side-to-side direction of the seating unit. Additionally, relative location terminology will be utilized herein. For example, the term "proximate" is intended to mean on, about, near, by, next to, at, and the like. Therefore, when a feature is proximate another feature, it is close in proximity but not necessarily exactly at the described location, in some aspects. Additionally, the term "distal" refers to a portion of a feature herein that is positioned away from a midpoint of the feature.

Figure 2:
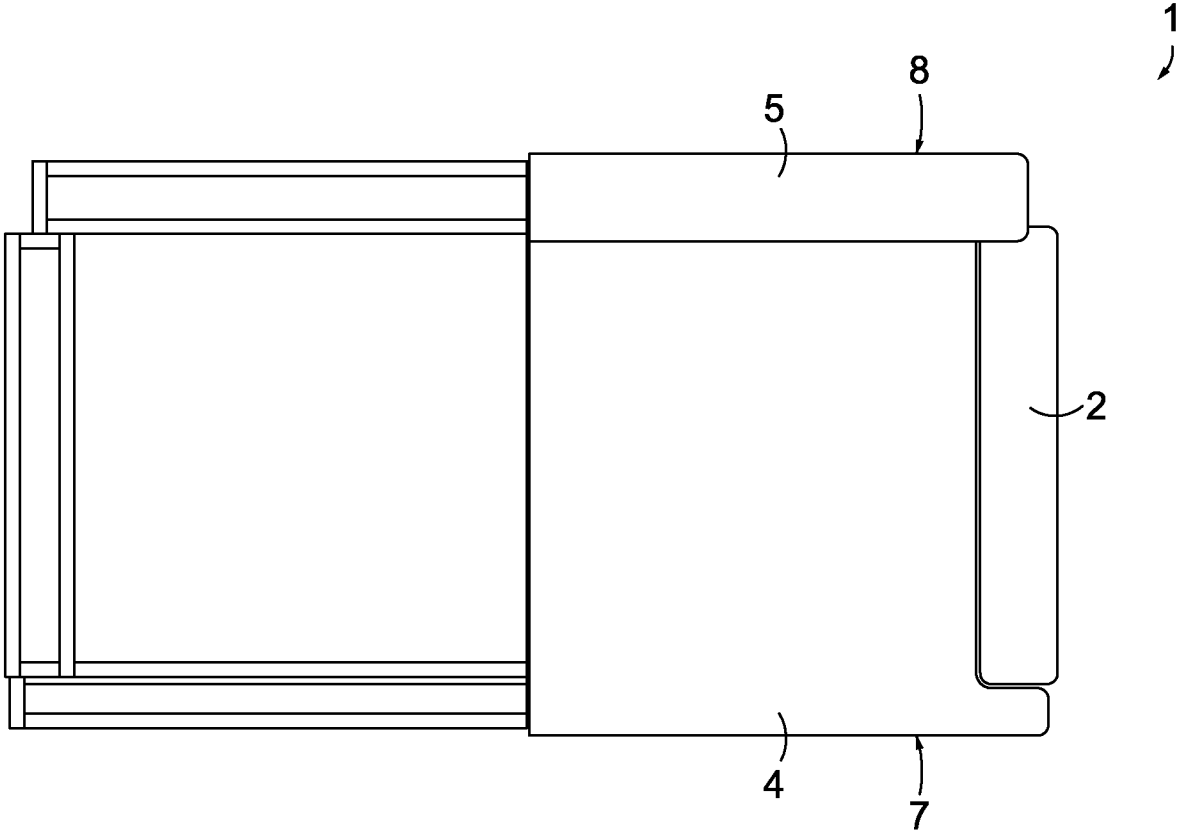
FIG. 2 is a top view of the upholstered portion of the seating unit of FIG. 1, in accordance with aspects hereof.

FIGS. 1-5 illustrate a reclining seating unit 1. As shown in FIG. 1, the reclining seating unit 1 includes an arm 2 supported by legs 3 on a seating supporting surface (not shown). A seat 4 and a back 5 are separately coupled to the reclining seating unit 1 by a recliner mechanism 10. One or more ottomans 6 (e.g., a foot support ottoman, a leg support ottoman, etc.) may also coupled to the reclining seating unit 1 by the recliner mechanism 10 through a footrest linkage assembly 14 (best seen in FIGS. 7 and 8). The back 5 is illustrated as a winged back and the seat 4 has a T-cushion (as seen in FIG. 2). In operation, the back 5 is configured to pivot over the arm 2. As shown in FIG. 2, the reclining seating unit 1 has a front 7 opposite a back 8. Returning to FIG. 1, each of the arm 2, the seat 4, the back 5, and the one or more ottomans 6 may include one or more frame members 9 to which upholstery may be applied. Not all of the one or more frame members 9 are labeled in FIG. 1. While it appears that several of the one or more frame members 9 (e.g., at the arm 2 and the back 5) may interfere with one another when the back 5 is reclined, it is apparent from FIGS. 3-5 that said frame members do not interfere and include a stylized design having varied vertical heights in the longitudinal direction.

Figure 3:
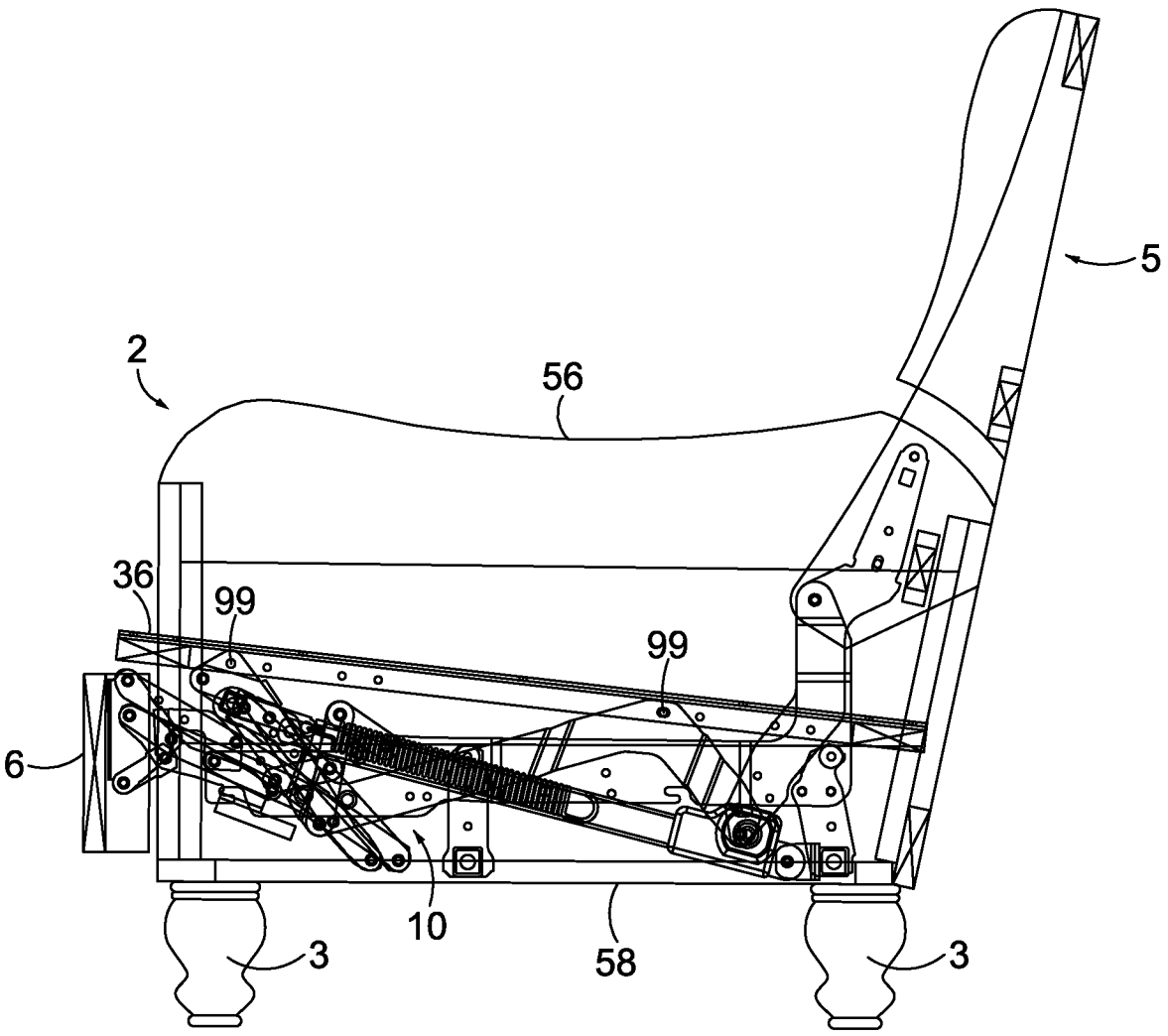
FIG. 3 is a cross-sectional view of the reclining seating unit of FIG. 1 in a closed position, in accordance with aspects hereof.
Figure 4:
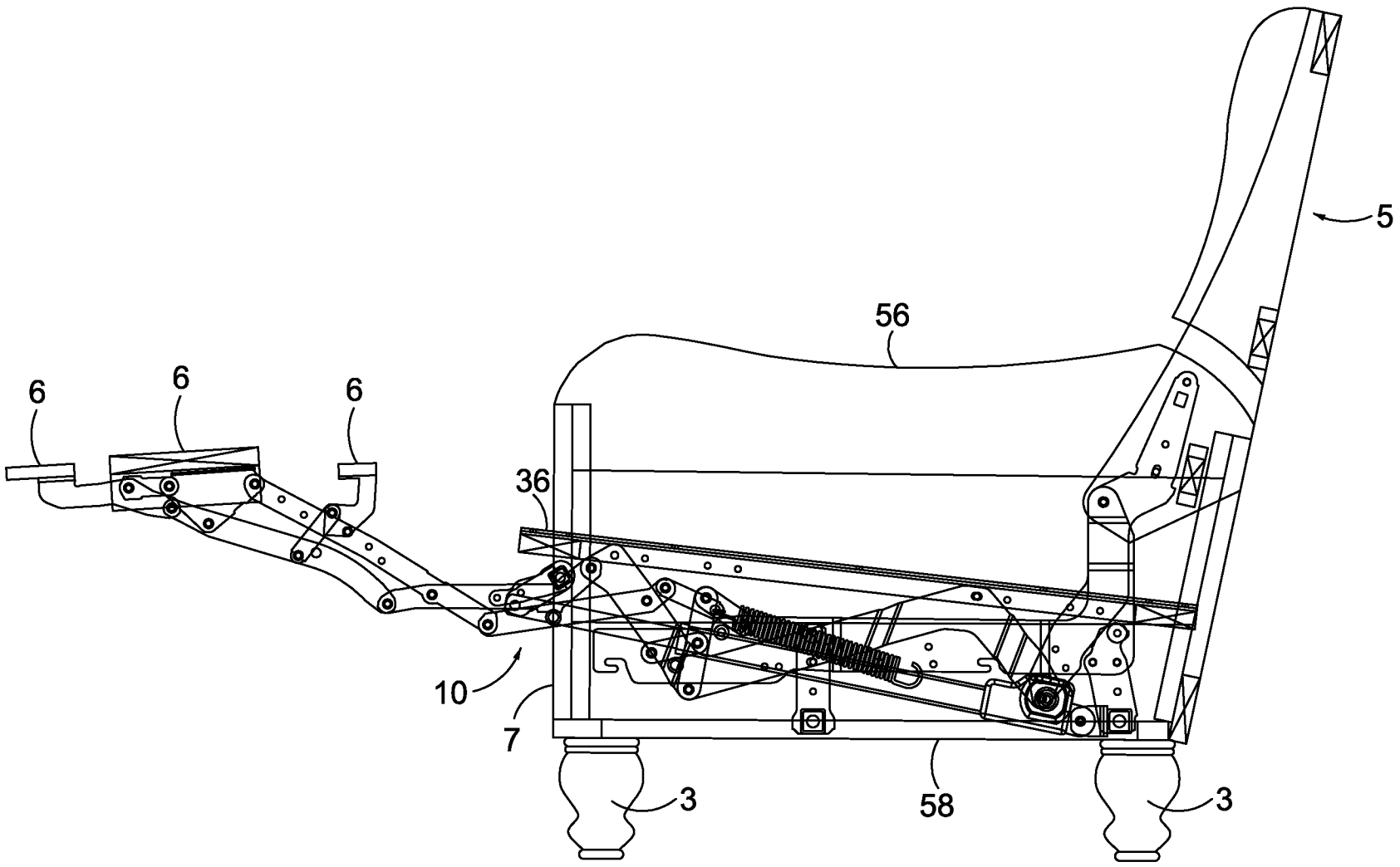
FIG. 4 is a cross-sectional view of the reclining seating unit of FIG. 1 in a TV position, in accordance with aspects hereof.
Figure 5:
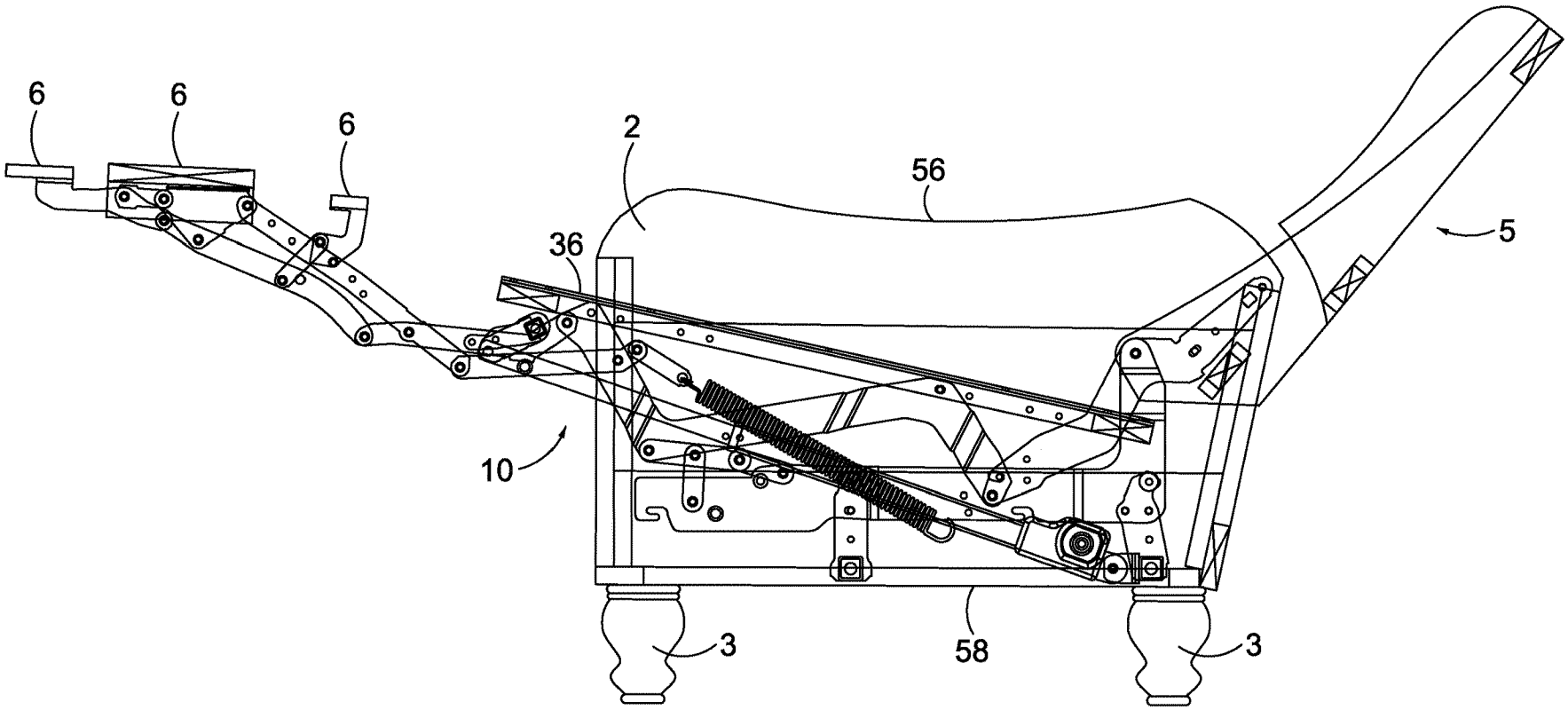
FIG. 5 is a cross-sectional view of the reclining seating unit of FIG. 1 in a fully reclined position, in accordance with aspects hereof.

FIGS. 3-5 illustrate side views of the reclining seating unit 1 in a closed position (FIG. 3), a TV position (FIG. 4), and a fully reclined position (FIG. 5). The seat 4 has been removed for clarity. The seat 4 is carried on a seat rail 36 connected to the recliner mechanism 10. Arms 2 are laterally spaced and have an upper arm portion 56 and a lower arm portion 58. Arms 2 and legs 3 support the recliner mechanisms 10, seat rail 36 and seat 4 on the seating support surface (not shown) that is disposed between the pair of opposed side arms 2, and the back 5. Back 5 is coupled to the recliner mechanism 10 near the upper arm portion 56. Legs 3 support the arms 2 and raise the arms 2 above the seating support surface (not shown). In other aspects, the arms 2 may contact the seating support surface (not shown) directly and the reclining seating unit 1 may have no legs 3. The recliner mechanism 10 is arranged to articulably actuate and control movement of the seat 4, the back 5, and the one or more ottomans 6 between the positions shown in FIGS. 3-5, as more fully described below.

As shown in FIGS. 3-5, the reclining seating unit 1 is adjustable to three basic positions. FIG. 3 depicts a closed position, which is a normal non-reclined sitting position with the seat 4 in a generally horizontal position and the back 5 substantially upright. In the closed position, the one or more ottomans 6 are positioned below the seat 4. FIG. 4 depicts a TV position (also referred to as an extended position in the furniture manufacturing industry) in which the one or more ottomans 6 are extended forward of the front 7 of the reclining seating unit 1 and disposed generally horizontal. Three ottomans 6 are present in the illustrated aspect, however, in other aspects one, two, or more ottomans may be coupled to the recliner mechanism 10. In the TV position, the position of the seat 4 remains substantially unchanged from the closed position. This allows a T-cushion style of seat cushion for seat 4. Generally, the T-cushion extends forward between arms 2 of the reclining seating unit 1 such that the front of the cushion is not held between arms 2 as best seen in FIG. 2. Further, in the TV position, the angle of inclination of back 5 remains unchanged, and will not encroach an adjacent wall. Thus, the configuration gives the user a TV position while providing a space saving utility. FIG. 5 depicts a fully reclined position in which the seat 4 and the one or ottomans 6 have moved forward and upward. In the fully reclined position, the back 5 is rotated over the upper arm portion 56 in a rearward inclination angle. The rearward inclination angle of the fully reclined position causes the back 5 to move rearwardly to some degree. However, the rearward movement is minimized such that the back 5 moves only around six inches rearwardly relative to its position in the closed and/or TV position. This is in contrast to other reclining chairs with 3-position mechanisms, which cause a backrest to move rearward around eighteen inches. Thus, the combination of the rotation of the back 5 over the upper arm portion 56, and the forward movement of the seat 4 provide for a second space saving utility of the present invention.

Figure 6:
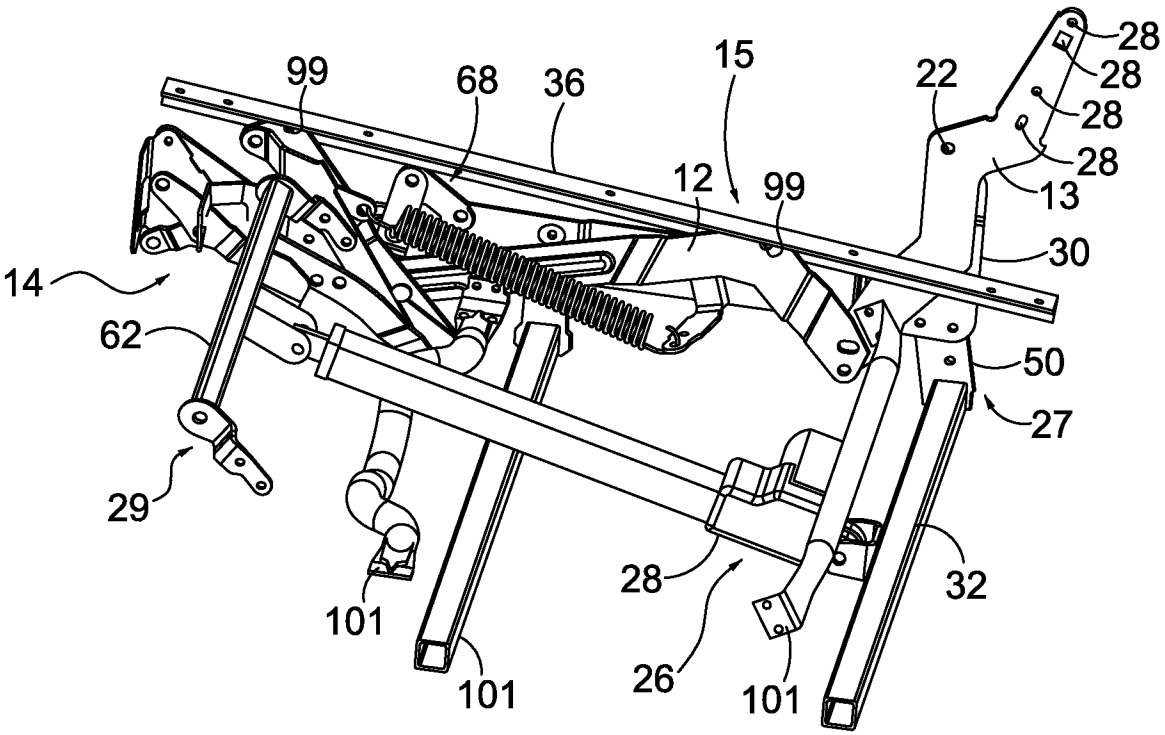
FIG. 6 is a side perspective view of a recliner mechanism in a closed position, showing only one side for clarity, in accordance with aspects hereof.
Figure 7:
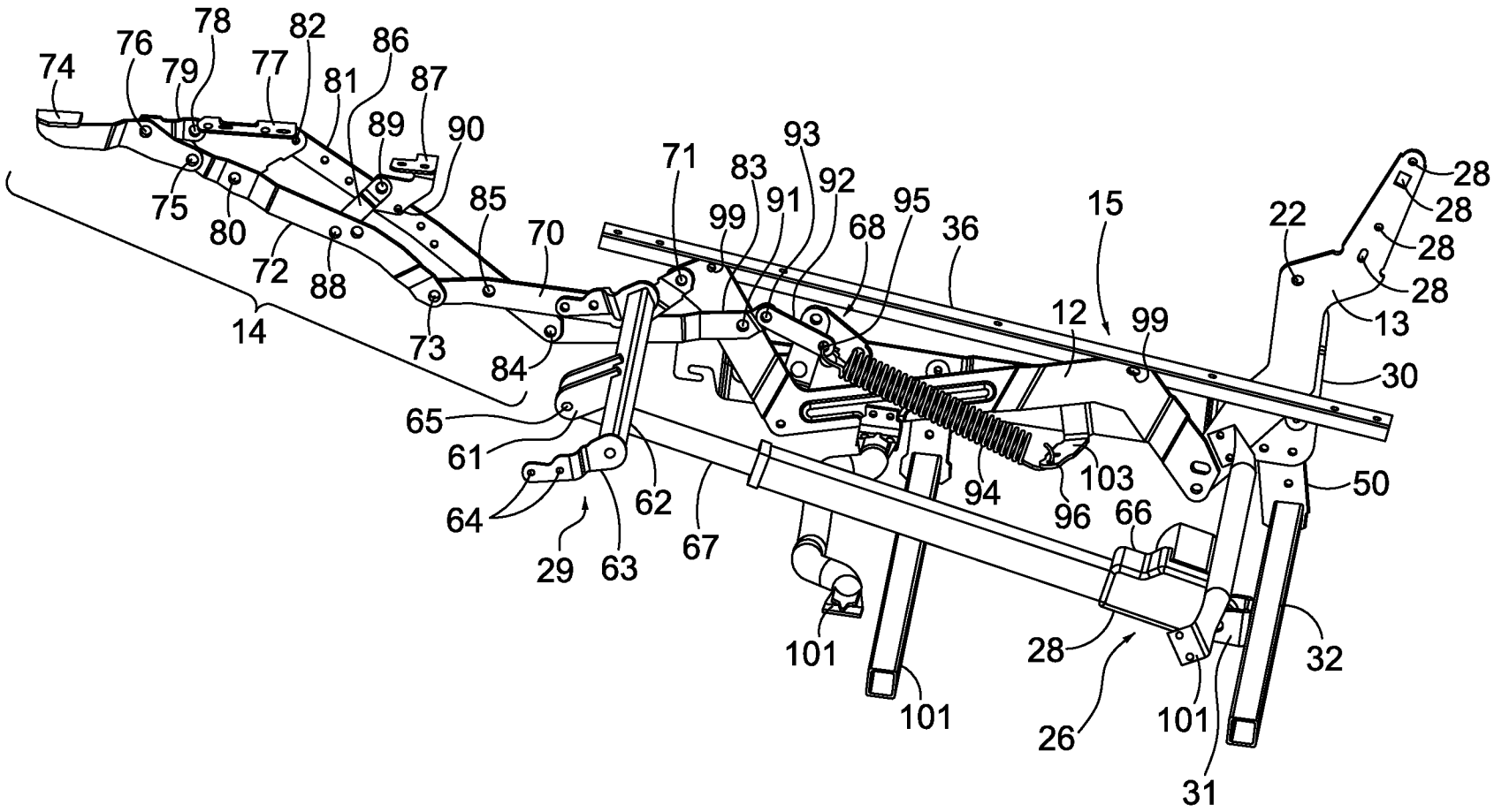
FIG. 7 is a side perspective view of the recliner mechanism of FIG. 6 in a TV position, in accordance with aspects hereof.
Figure 8:
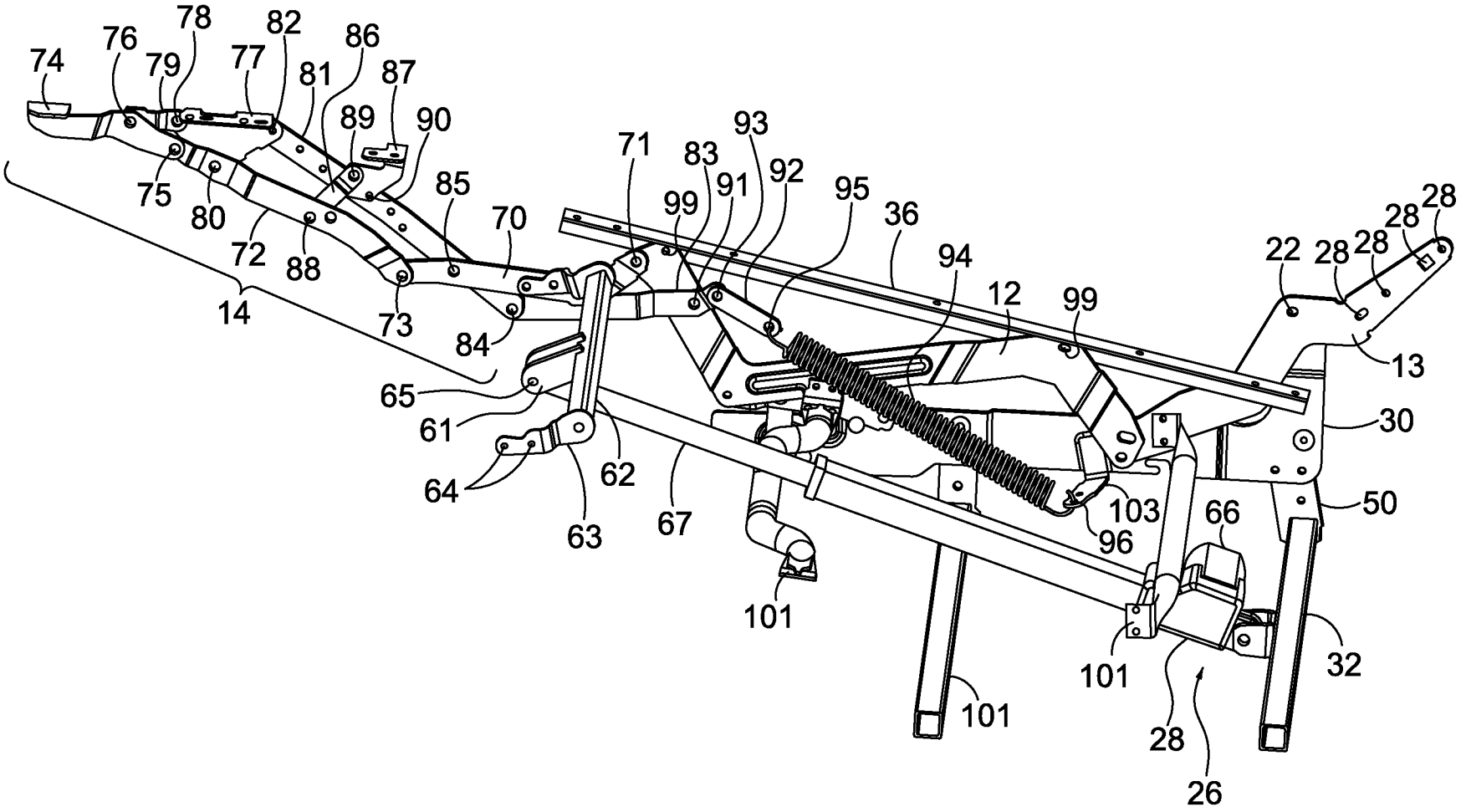
FIG. 8 is a side perspective view of the recliner mechanism of FIG. 6 in a fully reclined position, in accordance with aspects hereof.
Figure 9:
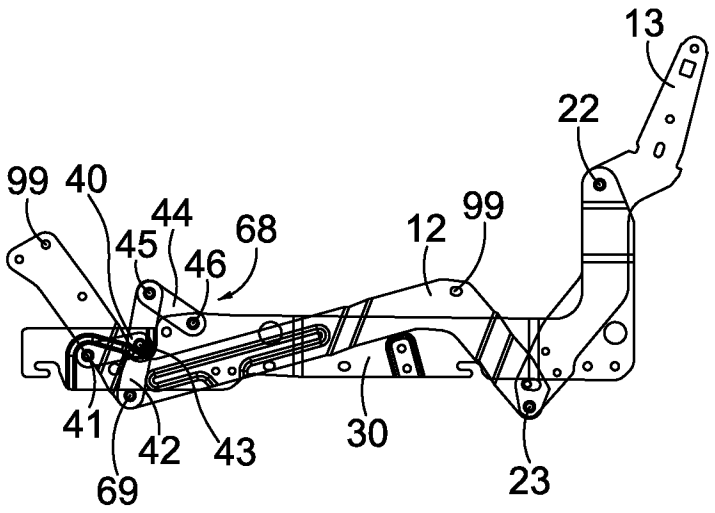
FIG. 9 is a detail view of selected parts of the recliner mechanism of FIG. 6, with a footrest assembly and a linear actuator removed, in accordance with aspects hereof.
Figure 10:
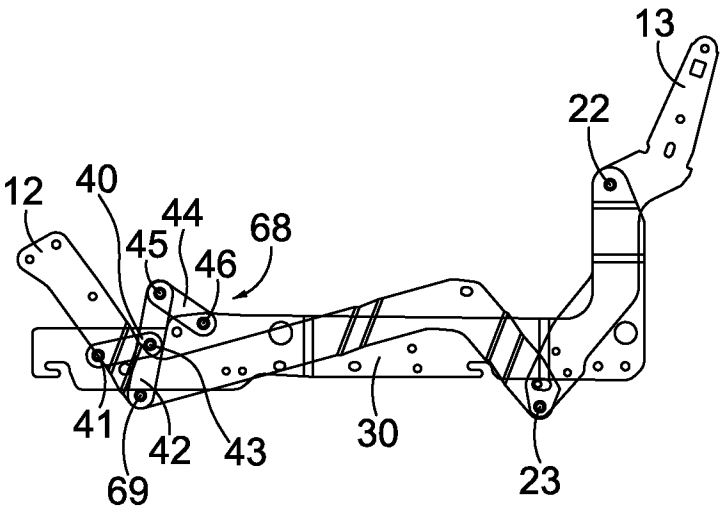
FIG. 10 is a detail view of selected parts the recliner mechanism of FIG. 7, with a footrest assembly and a linear actuator removed, in accordance with aspects hereof.
Figure 11:
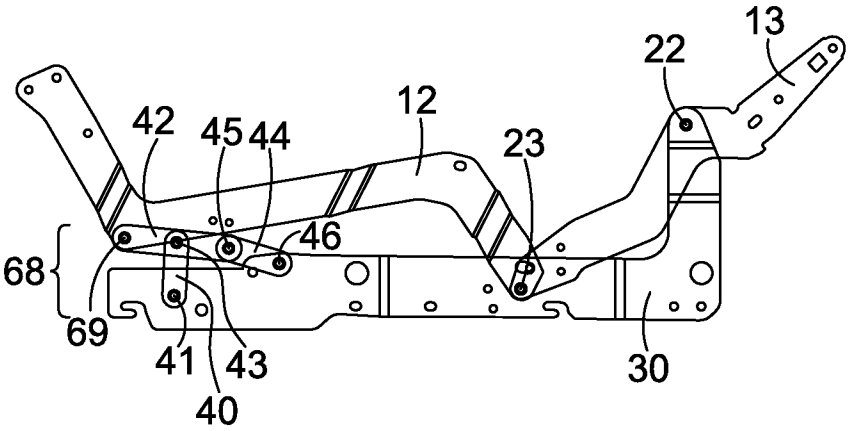
FIG. 11 is a detail view of selected parts the recliner mechanism of FIG. 8, with a footrest assembly and a linear actuator removed, in accordance with aspects hereof.

Turning to FIGS. 6-8, the recliner mechanism 10 comprises two essentially mirror-image recliner structures 15 respectively mounted in opposing facing relation. Recliner structure 15 broadly includes a seat rail link 12, a back mounting bracket 13, a footrest linkage assembly 14 (see FIGS. 7 and 8), a full recline assembly 68 (as best seen in FIGS. 9-11), and a linear actuator assembly 26. The recliner structures 15 are supported on the reclining seating unit 1 through a pair of arm mounting brackets 30 and connected by a rear motor cross tube 32, a front motor cross tube 62, and one or more lateral support tubes 101. Arm mounting brackets 30 are coupled to the arms 2, such as with bolts, screws or pins. The front motor cross tube 62, rear motor cross tube 32 and the lateral supports 101 may be arranged substantially perpendicular to the arm mounting brackets 30. Rear motor tube 32 and front motor tube 62 are made from a generally rigid material, such as square steel tubing or square stock, and generally extend between the opposed arms brackets 30. Lateral support tubes 101 may also be made from a square or round metal tubing, and may be bent to provide clearance for other parts. In the illustrated aspect, each respective end of the rear motor cross tube 32 is coupled to a rear motor attachment bracket 50, which in turn is coupled to the arm mounting bracket 30. One embodiment of the arm mounting bracket 30 attachment to the arm 2 is a wedge-lock KD (knock down) arm that provides for assembly of additional seats to a seating unit. Each of the arm mounting brackets 30 support a respective mirror-image recliner structure 15 and allows the seat 4, the one or more ottomans 6 and back 5 to move relative to the arms 2.

Arm mounting bracket 30 is generally L-shaped as best seen in FIG. 9. The rear section of the arm mounting bracket 30 has a generally vertical section that allows rotatable attachment of a back mounting bracket 13 at a pivot point 22. As set forth in more detail below, the recliner structure 15 is pivotally coupled to a respective arm mounting bracket 30 at the pivot point 22 and at the full recline assembly 68.

As would be understood by those of skill in the art, back 5 is coupled to back mounting bracket 13. For example, the back 5 may attach to the back mounting bracket 13 with a KD (knock down) connection, a ready to assemble (RTA) connection, or any other suitable fasteners which are well known in the furniture manufacturing industry. One or more holes 28 may be used to attach back 5 to back mounting bracket 13. One of ordinary skill in the art would understand that other attachment methods could be used.

Back mounting bracket 13 has an upper part, a central portion, and a lower part. The upper part includes the one or more holes 28. The pivot point 22 is located in the central portion and pivotally couples the back mounting bracket 13 to the arm mounting bracket 30. As best seen in FIG. 9, the lower part is pivotally coupled to seat rail link 12 at pivot point 23. The seat rail link 12 is shaped as shown and is configured to carry the seat rail 36 as shown in FIGS. 3-5. Seat rail link 12 extends forwardly from point 23 towards the front of seat rail 36, and is connected to seat rail 36 at holes 99.

As best seen in FIGS. 9-11, the full recline assembly 68 is pivotally coupled to the seat rail link 12 at intermediate pivot point 69. The full recline assembly 68 comprises a front full recline pivot link 40, a center full recline pivot link 42, and a rear full recline pivot link 44. The front full recline pivot link 40 is pivotally coupled on one end to a front portion of the arm mounting bracket 30 at pivot point 41. The front full recline pivot link 40 is pivotally coupled on the opposite end to the center full recline pivot link 42 at pivot point 43. The center full recline pivot link 42 is pivotally coupled on one end to the seat rail link 12 at the intermediate pivot point 69. The center full recline pivot link 42 is pivotally coupled on the opposite end to one end of the rear full recline pivot link 44 at pivot point 45. The pivot point 43 is positioned between the intermediate pivot point 69 and the pivot point 45. The rear full recline pivot link 44 is pivotally coupled on the other end to arm mounting bracket 30 at pivot point 46. The pivot point 41 may be located on the arm mounting bracket 30 forward of the pivot point 46.

As best seen in FIGS. 7-8, the footrest linkage assembly 14 may be pivotally coupled to a forward end of the seat rail link 12. For example, the footrest linkage assembly may be connected to the seat rail link 12 forward of the full recline assembly 68. The footrest assembly 14 includes the following components. A second upper ottoman link 70 may pivotally coupled to the seat rail link 12 at pivot point 71 and may extend forwardly therefrom when the footrest linkage assembly 14 is extended, as shown in FIG. 8. The second upper ottoman link 70 is pivotally coupled on an opposite end to a first lower ottoman link 72 at pivot point 73. The first lower ottoman link 72 is pivotally coupled on the other end to a secondary ottoman bracket 74 at pivot point 75. A secondary ottoman (6) is configured to fasten to the secondary ottoman bracket 74. A secondary ottoman pivot link 79 is coupled on one end to the secondary ottoman bracket 74 at pivot point 76 and extends rearwardly to pivotally couple to a main ottoman bracket 77 at pivot point 78. The main ottoman bracket 77 is also pivotally coupled to an intermediate pivot point 80 on the first lower ottoman link 72. A main ottoman (6) is configured to fasten to the main ottoman bracket 77. A first upper ottoman link 81 extends rearwardly from pivot point 82 on the main ottoman bracket 77. An opposite end of the first upper ottoman link 81 is pivotally coupled to a second lower ottoman link 83 at pivot point 84. The first upper ottoman link 81 is pivotally coupled to the second upper ottoman link 70 at an intermediate pivot point 85. A mid ottoman pivot link 86 may be pivotally coupled between the first lower ottoman link 72 and a mid-ottoman bracket 87 at intermediate pivot point 88 and pivot point 89, respectively. A mid ottoman (6) may be fastened to the mid ottoman bracket 87. The mid ottoman bracket 87 is also pivotally coupled to the first upper ottoman link 81 at intermediate pivot point 90. The second lower ottoman link 83 is also pivotally coupled to the seat rail link 12 at pivot point 91. A spring connect link 92 may be pivotally coupled to a rearward end of the second lower ottoman link 83 at pivot point 93 and extend rearwardly therefrom. An opposite end of the spring connect link 92 may be coupled to a spring 94 at coupling point 95. An opposite end of the spring 94 is coupled to an arm bracket 103 at coupling point 96. The spring 94 may assist the footrest linkage assembly 14 to move from the closed position to the extended position by causing a force to be exerted on the rearward end of the second lower ottoman link 83 promoting clockwise (as viewed in FIG. 8) rotation around pivot point 91. It should be noted, however, that in some aspects the footrest linkage assembly 14 does not include the spring 94 or the spring connect link 92 and arm bracket 103, and said assembly is moved from the closed position to the extended position solely by the linear actuator discussed below.

The links and brackets described herein may be formed from a sturdy material, such as stamped, formed steel. It should be understood that other suitable materials could also be used. The pivotal couplings, such as the pivot points discussed herein, may be made by pins, rivets, bearings, bolts, or any other suitable fasteners which are well known in the furniture manufacturing industry.

Figure 13:
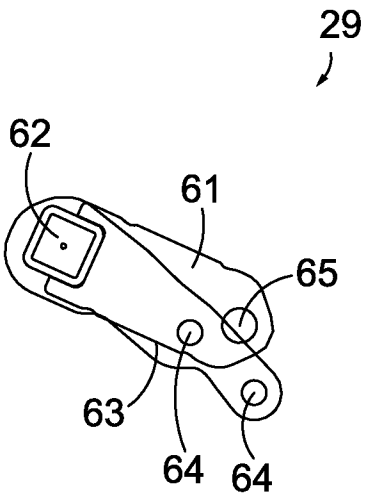
FIG. 13 is a detail view illustrating a second linear actuator attachment assembly, in accordance with aspects hereof.
Figure 12:
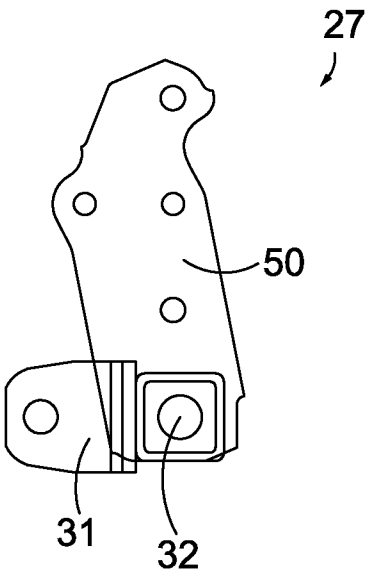
FIG. 12 is a detail view illustrating a first linear actuator attachment assembly, in accordance with aspects hereof.

The linear actuator assembly 26 moves the reclining structures 15, and thus the reclining seating unit 1 between the closed position, the fully reclined position, and positions intermediate thereto (e.g., the TV position). The linear actuator assembly 26 may include a rear coupling assembly 27, a linear actuator 28, and a front coupling assembly 29. The rear coupling assembly 27 includes the rear motor attachment brackets 50, the rear motor cross tube 32, and a clevis 31. The linear actuator 28 is pivotally coupled to the rear coupling assembly 27 via the clevis 31. As best seen in FIGS. 7, 8 and 13, the front coupling assembly 29 includes a front motor mount bracket 61 fixedly coupled to a front motor cross tube 62 and a pair of front motor attachment brackets 63 fixedly coupled to either end of the front motor cross tube 62. One of the front motor attachment brackets 63 is fixedly coupled to each of the recliner structures 15. For example, each of the front motor attachment brackets 63 may be fastened to the second upper ottoman link 70. In some aspects, each of the front motor attachment brackets 63 include apertures 64 for receiving rivets or other fasteners therethrough. One end of the linear actuator 28 may be pivotally coupled to the front motor mount bracket 61 at pivot point 65. The linear actuator 28 may include a motor mechanism 66 and an extension member 67.

The operation of the recliner mechanism 10 within the reclining seating unit 1, and particularly of the opposed recliner structures 15, is depicted in FIGS. 6-8, which correspond to the sequence shown in FIGS. 3-5 and 9-11. In FIG. 6, the recliner structure 15 is shown in the closed position, with the back mounting bracket 13 generally vertical, the footrest linkage assembly 14 fully retracted within the reclining seating unit 1.

In use, the user of the reclining seating unit 1 can adjust the recliner mechanism 10 from the closed position to the TV position by activating the motor mechanism 66 to cause the extension rod 67 to extend and unfold the footrest linkage assembly 14. The reclining seating unit 1 is adjusted from the TV position to the fully reclined position when the user activates the motor mechanism 66 to cause full extension of the extension rod 67. The extension rod 67 is at a first state when the reclining seating unit 1 is in the closed position. The extension rod 67 is at a second state when the reclining seating unit 1 is in the TV position. The extension rod 67 is at a third state when the reclining seating unit 1 is in the fully reclined position. In some aspects, the extension rod 67 may have any number of states intermediate to the first state and the third state such that the reclining seating unit 1 is positioned intermediate to the closed position and the fully reclined position. The motor mechanism 66 may be activated to reverse the above described process.

Figure 14:
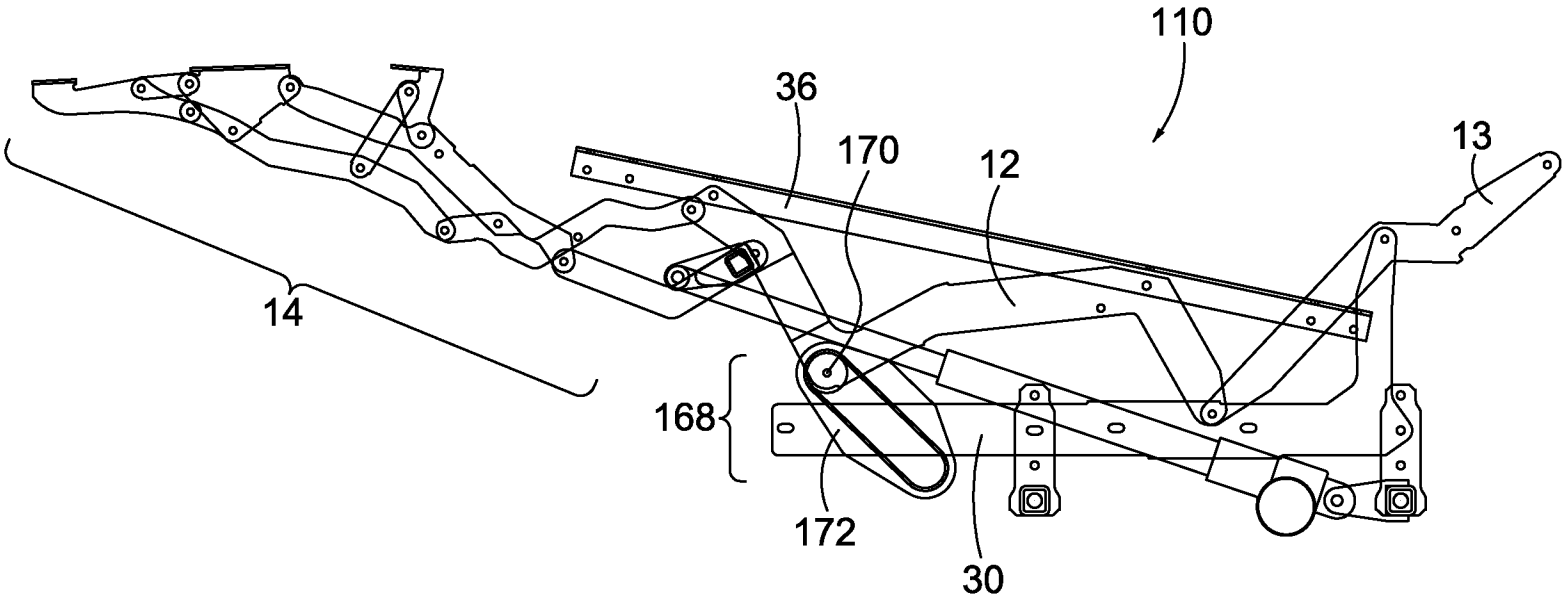
FIG. 14 is a side view of another embodiment of a recliner mechanism in a fully reclined position, in accordance with aspects hereof.
Figure 15:
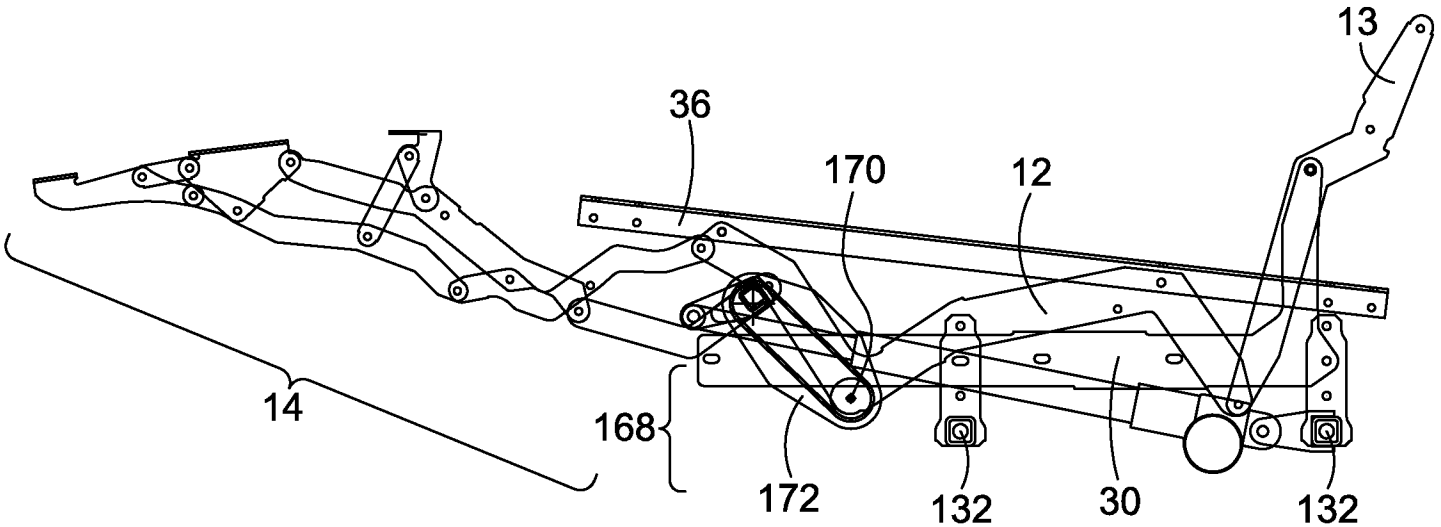
FIG. 15 is a side view of the recliner mechanism of FIG. 14 in a TV position, in accordance with aspects hereof.
Figure 16:
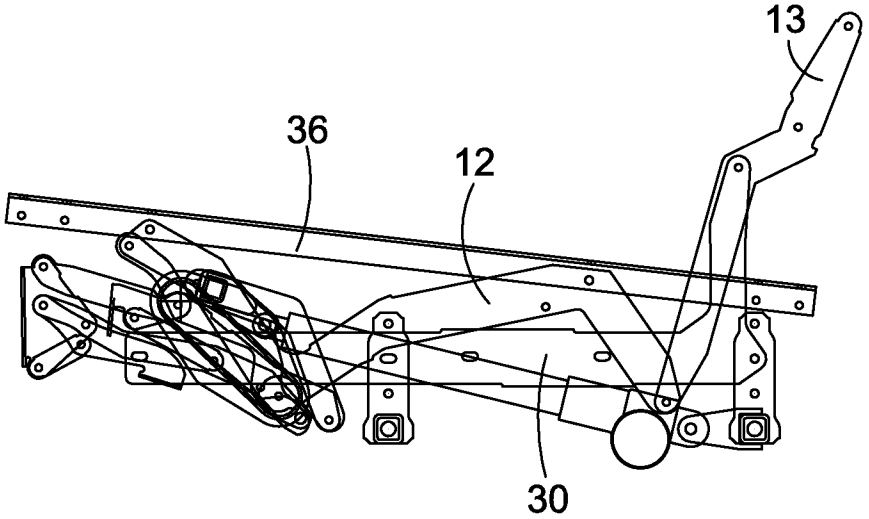
FIG. 16 is a side view of the recliner mechanism of FIG. 15 in a closed position, in accordance with aspects hereof.

FIGS. 14-16 illustrate an alternative aspect of a reclining seating unit 110. The reclining seating unit 110 is much the same as the reclining seating unit 1, however, the forward coupling between the seat rail link 12 and the arm mounting bracket 30 has changed. Like parts have been labeled with like numbers. The full recline assembly 68 has been replaced with another aspect of a full recline assembly 168. The full recline assembly 168 includes a roller 170 rotationally coupled to the seat rail link 12 and a track 172 coupled to the arm mounting bracket 30. The roller 170 is received in the track 172 and rolls from a first state (FIGS. 15 and 16) to a second state (FIG. 14) as the reclining seating unit 101 moves from the closed/TV position to the fully reclined position.

Persons familiar with the field of the invention will realize that it may be practiced by various devices which are different from the specific illustrated embodiments. Therefore, it is emphasized that the invention is not limited only to this embodiment but is embracing of a wide variety of mechanisms which fall within the spirit of the following claims.

What is claimed:

1. A linkage mechanism having a recline linkage for a seating unit, the recline linkage comprising:

an arm mounting bracket;

a back mounting bracket having a first end opposite a second end, the back mounting bracket pivotally coupled to the arm mounting bracket between the first end and the second end, the first end being configured for coupling to a seat back;

a seat rail link pivotally coupled to the second end of the back mounting bracket and configured for coupling to a seat rail; and a full recline linkage assembly coupled to the seat rail link forward of the pivotal coupling between the seat rail link and the second end of the back mounting bracket, the full recline linkage assembly coupled to the arm mounting bracket forward of the pivotal coupling between the arm mounting bracket and the back mounting bracket.

2. The linkage mechanism of claim 1, wherein the seating unit comprises an arm-to-floor seating unit.

3. The linkage mechanism of claim 1, wherein the seating unit comprises a pivot-over-the arm seating unit.

4. The linkage mechanism of claim 1, wherein the seating unit comprises a "T" cushion seat.

5. The linkage mechanism of claim 1, wherein the full recline linkage assembly comprises:

a rear full recline pivot link pivotally coupled to the arm mounting bracket on a third end, the rear full recline pivot link having a fourth end opposite the third end;

a center full recline pivot link pivotally coupled on a fifth end to the fourth end of the rear full recline pivot link, the center full recline pivot link having a sixth end opposite the fifth end, the sixth end of the center full recline pivot link being pivotally coupled to the seat rail link; and a front full recline pivot link having a seventh end opposite an eighth end, the seventh end pivotally coupled to the arm mounting bracket and the eighth end pivotally coupled to the center full recline pivot link between the fifth end and the sixth end.

6. The linkage mechanism of claim 1, further comprising an ottoman assembly pivotally coupled to the seat rail link and configured to move between a closed position and an extended position.

7. The linkage mechanism of claim 6, further comprising a linear actuator coupled to the arm mounting bracket and the ottoman assembly for moving the seating unit between a closed position, an extended position, and a reclined position.

8. A linkage mechanism for a seating unit, the recline linkage comprising:

an arm mounting link;

a back mounting bracket having a first end opposite a second end, the back mounting bracket pivotally coupled to the arm mounting bracket between the first end and the second end, the first end being configured for coupling to a seat back;

a seat rail link pivotally coupled to the second end of the back mounting bracket and extending forwardly therefrom;

a full recline assembly coupling the seat rail link to the arm mounting bracket;

a seat rail coupled to the seat rail link and configured to carry a seat of the seating unit; and an ottoman assembly coupled to the seat rail link and configured to move between a closed position and an extended position.

9. The recline linkage of claim 8 further comprising a linear actuator coupled to the arm mounting bracket and the ottoman assembly for moving the seating unit between a closed position, an extended position, and a reclined position.

10. The recline linkage of claim 8, wherein the full recline assembly comprises:

a roller coupled to the seat rail; and a track coupled to the arm mounting bracket, wherein the roller is operatively engaged in the track, wherein the roller is positioned at one end of the track when the seating unit is in a closed position and is positioned at an opposite end of the track when the seating unit is in a reclined position.

11. The recline linkage of claim 10, wherein the roller remains at the one end of the track when the seating unit moves from the closed position to the extended position.

12. The recline linkage of claim 8, wherein the full recline assembly comprises:

a rear full recline pivot link pivotally coupled to the arm mounting bracket;

a center full recline pivot link pivotally coupled to the rear full recline pivot link, the center full recline pivot link also being pivotally coupled to the seat rail link; and a front full recline pivot link pivotally coupled to the arm mounting link, the front full recline pivot link also being pivotally coupled to the center full recline pivot link.

13. A seating unit with a linkage mechanism having a recline linkage, the seating unit comprising:

an arm mounting bracket;

a back mounting bracket having a first end opposite a second end, the back mounting bracket pivotally coupled to the arm mounting bracket between the first end and the second end, the first end being configured for coupling to a seat back;

a seat rail link pivotally coupled to the second end of the hack mounting bracket and configured for coupling to a seat rail; and a full recline linkage assembly coupled to the seat rail link forward of the pivotal coupling between the seat rail link and the second end of the back mounting bracket, the full recline linkage assembly coupled to the arm mounting bracket forward of the pivotal coupling between the arm mounting bracket and the back mounting bracket.

14. The seating unit of claim 13, wherein the seating unit comprises an arm-to-floor seating unit.

15. The seating unit of claim 13, wherein the seating unit comprises a pivot-over-the arm seating, unit.

16. The seating unit of claim 13, wherein the seating unit comprises a "T" cushion seat.

17. The seating unit of claim 13, wherein the full recline linkage assembly comprises:

a rear full recline pivot link pivotally coupled to the arm mounting bracket on a third end, the rear full recline pivot link having a fourth end opposite the third end;

a center full recline pivot link pivotally coupled on a fifth end to the fourth end of the rear full recline pivot link, the center full recline pivot link having a sixth end opposite the fifth end, the sixth end of the center full recline pivot link being pivotally coupled to the seat rail link; and a front full recline pivot link having a seventh end opposite an eighth end, the seventh end pivotally coupled to the arm mounting bracket and the eighth end pivotally coupled to the center full recline pivot link between the fifth end and the sixth end.

18. The seating unit of claim 13 further comprising an ottoman assembly pivotally coupled to the seat rail link and configured to move between a closed position and an extended position.

19. The seating unit of claim 18 further comprising a linear actuator coupled to the arm mounting bracket and the ottoman assembly for moving the seating unit between a closed position, an extended position, and a reclined position.

* * * * *